US006676362B1

(12) United States Patent
Pickering

(10) Patent No.: US 6,676,362 B1
(45) Date of Patent: Jan. 13, 2004

(54) VEHICLE TRASH COMPACTOR

(76) Inventor: Paul M. Pickering, 11290 Templeton Dr., Cincinnati, OH (US) 45251

( * ) Notice: Subject to any disclaimer, the term of this patent is extended or adjusted under 35 U.S.C. 154(b) by 0 days.

(21) Appl. No.: 10/127,808

(22) Filed: Apr. 23, 2002

(51) Int. Cl.[7] ..... B30B 9/00

(52) U.S. Cl. ..... 414/517; 100/102; 100/226; 100/229 R; 100/229 A

(58) Field of Search ..... 414/517; 100/226, 100/229 R, 229 A, 102

(56) References Cited

U.S. PATENT DOCUMENTS 3,613,566 A * 10/1971 Shapleigh, Jr. et al. ..... 100/218
4,018,148 A * 4/1977 Wolbrink ..... 100/53
4,700,623 A * 10/1987 Durbin et al. ..... 100/52
4,719,852 A * 1/1988 Durbin et al. ..... 100/229 A
5,088,396 A * 2/1992 Thomas ..... 100/35

* cited by examiner

*Primary Examiner*—Steven A. Bratlie

(57) ABSTRACT

A vehicle trash compactor for keeping the passenger compartment neat and clean by allowing the user to comfortably compact the trash in the vehicle. The vehicle trash compactor includes a container assembly including a container having top, bottom, back, and side walls, and also an open front; and also includes a drawer assembly including a drawer being removably disposed in the container through the open front thereof, and having bottom, side, and front walls, and also having an angled rim for holding a trash bag; and further includes an assembly of compacting trash in the drawer including a motor being attached in the container, and also including a compacting member being movable in and out of the drawer for compacting trash in the drawer.

2 Claims, 6 Drawing Sheets

VEHICLE TRASH COMPACTOR

BACKGROUND OF THE INVENTION

1. Field of the Invention

The present invention relates to trash compactors for vehicles and more particularly pertains to a new vehicle trash compactor for keeping the passenger compartment neat and clean by allowing the user to comfortably compact the trash in the vehicle.

2. Description of the Prior Art

The use of trash compactors for vehicles is known in the prior art. More specifically, trash compactors for vehicles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,929,060; 4,072,097; 5,829,091; 6,148,472; 5,189,753; and Des. 379,187.

While these devices fulfill their respective, particular objectives and requirements, the aforementioned patents do not disclose a new vehicle trash compactor. The prior art includes inventions having housings and hand-operated pistons which are slidably disposed in the housings for squashing the trash into a compact form.

SUMMARY OF THE INVENTION

The general purpose of the present invention, which will be described subsequently in greater detail, is to provide a new vehicle trash compactor which has many of the advantages of the trash compactors for vehicles mentioned heretofore and many novel features that result in a new vehicle trash compactor which is not anticipated, rendered obvious, suggested, or even implied by any of the prior art trash compactors for vehicles, either alone or in any combination thereof. The present invention includes a container assembly including a container having top, bottom, back, and side walls, and also an open front; and also includes a drawer assembly including a drawer being removably disposed in the container through the open front thereof, and having bottom, side, and front walls, and also having an angled rim for holding a trash bag; and further includes an assembly of compacting trash in the drawer including a motor being attached in the container, and also including a compacting member being movable in and out of the drawer for compacting trash in the drawer. None of the prior art includes compactors having motors and tubular rams for compacting trash in vehicles.

There has thus been outlined, rather broadly, the more important features of the vehicle trash compactor in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new vehicle trash compactor which has many of the advantages of the trash compactors for vehicles mentioned heretofore and many novel features that result in a new vehicle trash compactor which is not anticipated, rendered obvious, suggested, or even implied by any of the prior art trash compactors for vehicles, either alone or in any combination thereof.

Still another object of the present invention is to provide a new vehicle trash compactor for keeping the passenger compartment neat and clean by allowing the user to comfortably compact the trash in the vehicle.

Still yet another object of the present invention is to provide a new vehicle trash compactor that is easy and convenient to set up and use.

Even still another object of the present invention is to provide a new vehicle trash compactor that can be conveniently located out of the way of the users of the vehicle by it either being part of a console or hidden under one of the passenger seats.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
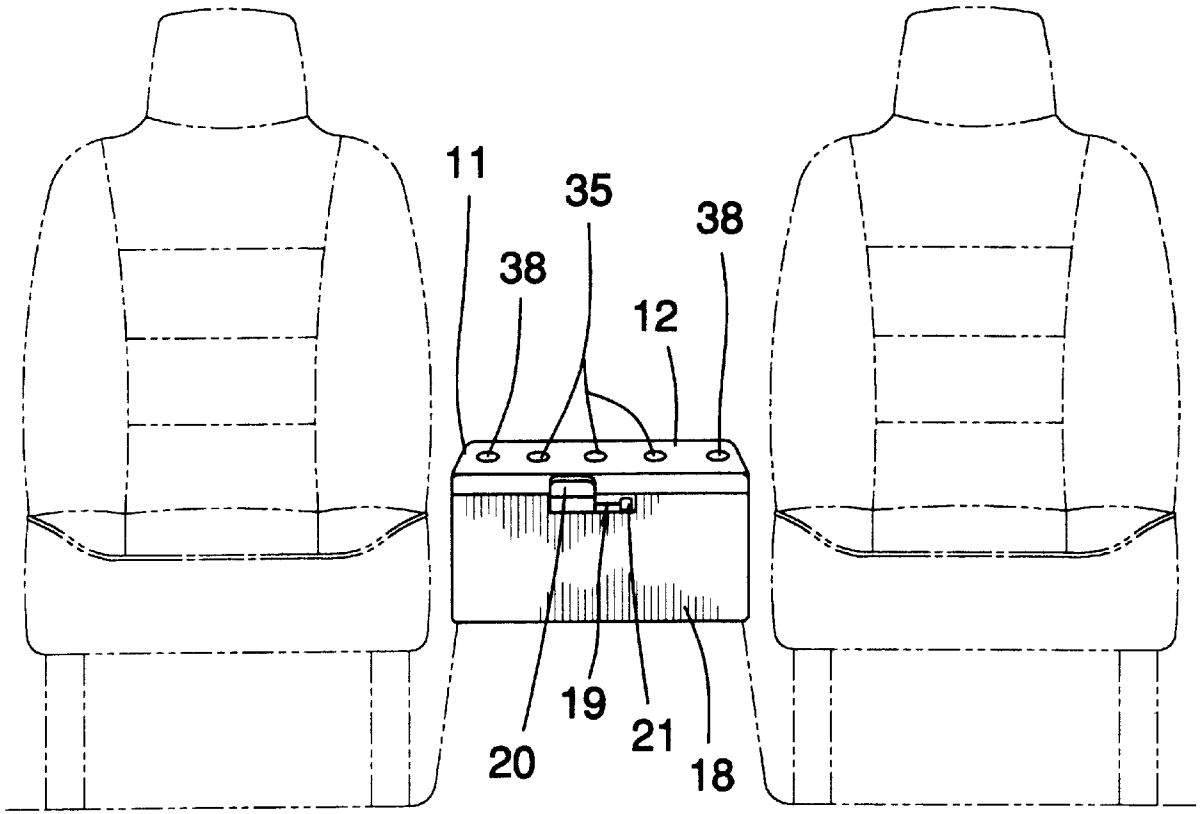
FIG. 1 is a perspective view of a new vehicle trash compactor according to the present invention and shown in use.
Figure 2:
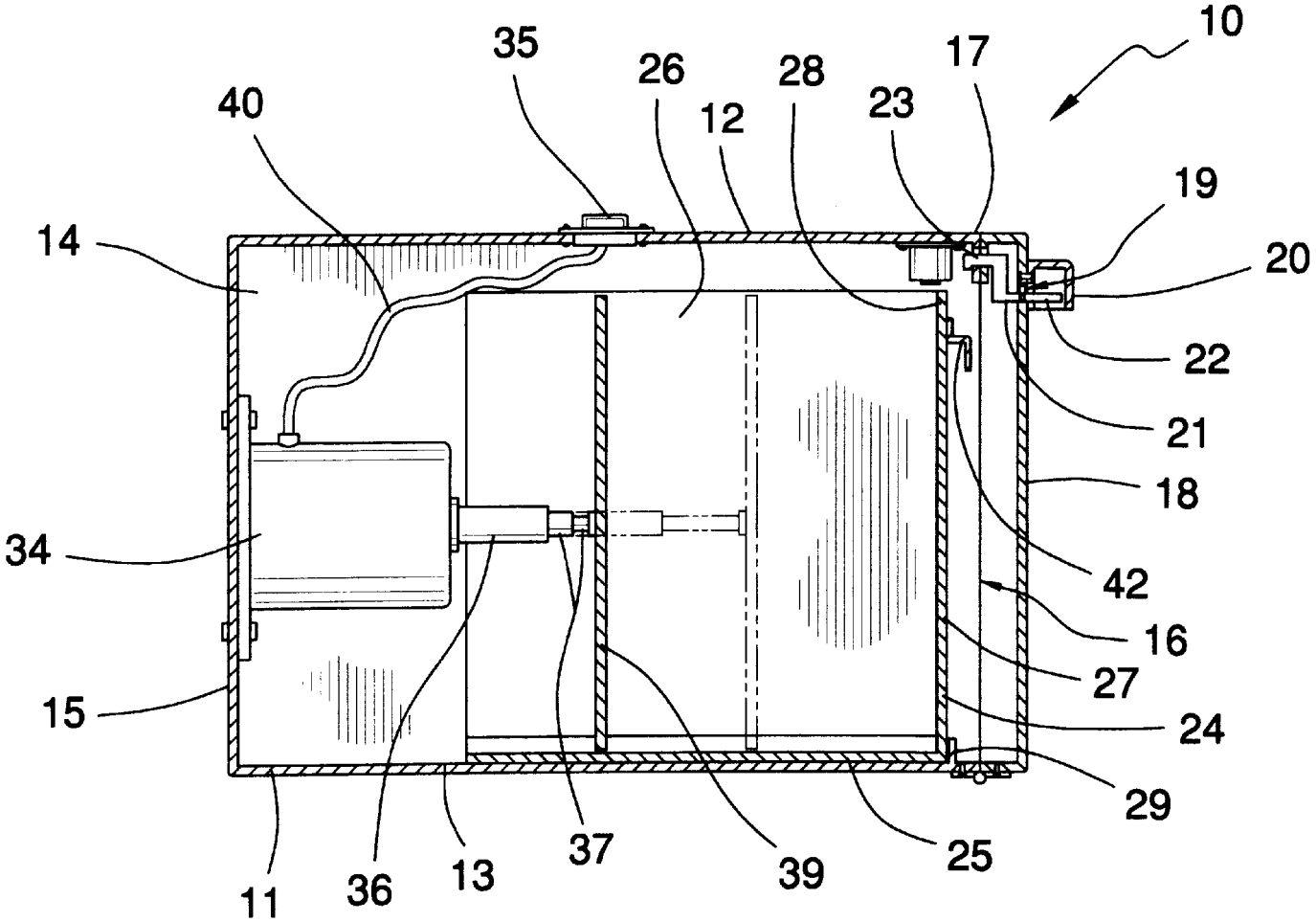
FIG. 2 is a cross-sectional view of the present invention.
Figure 3:
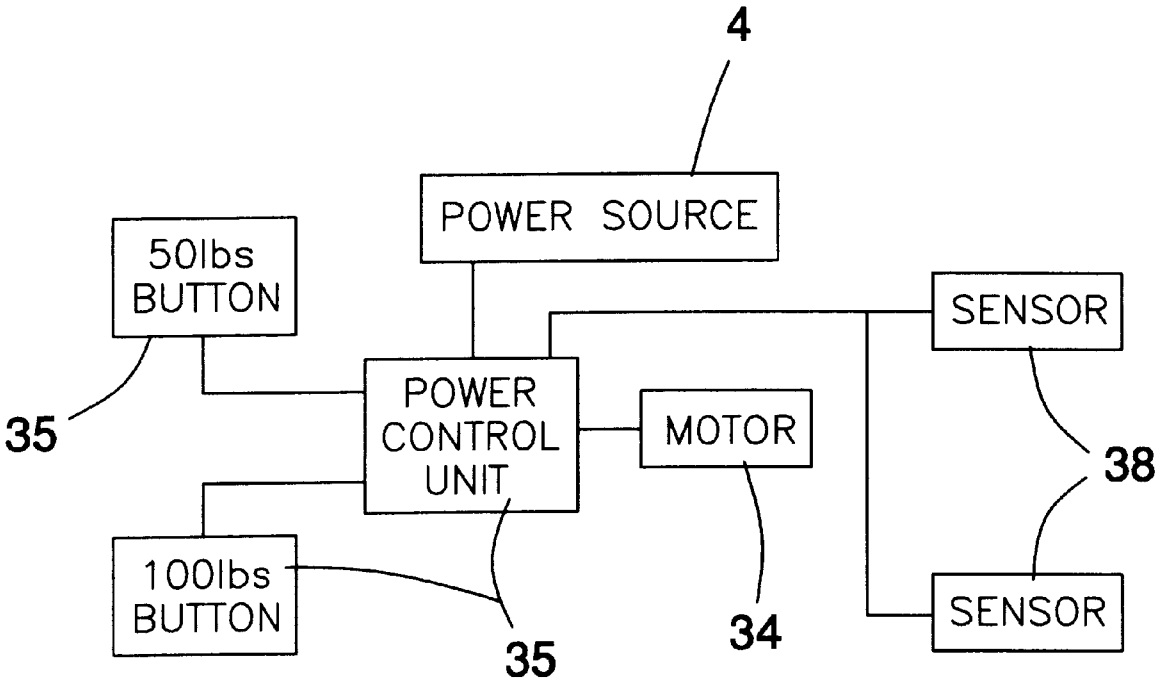
FIG. 3 is a schematic diagram of the present invention.
Figure 4:
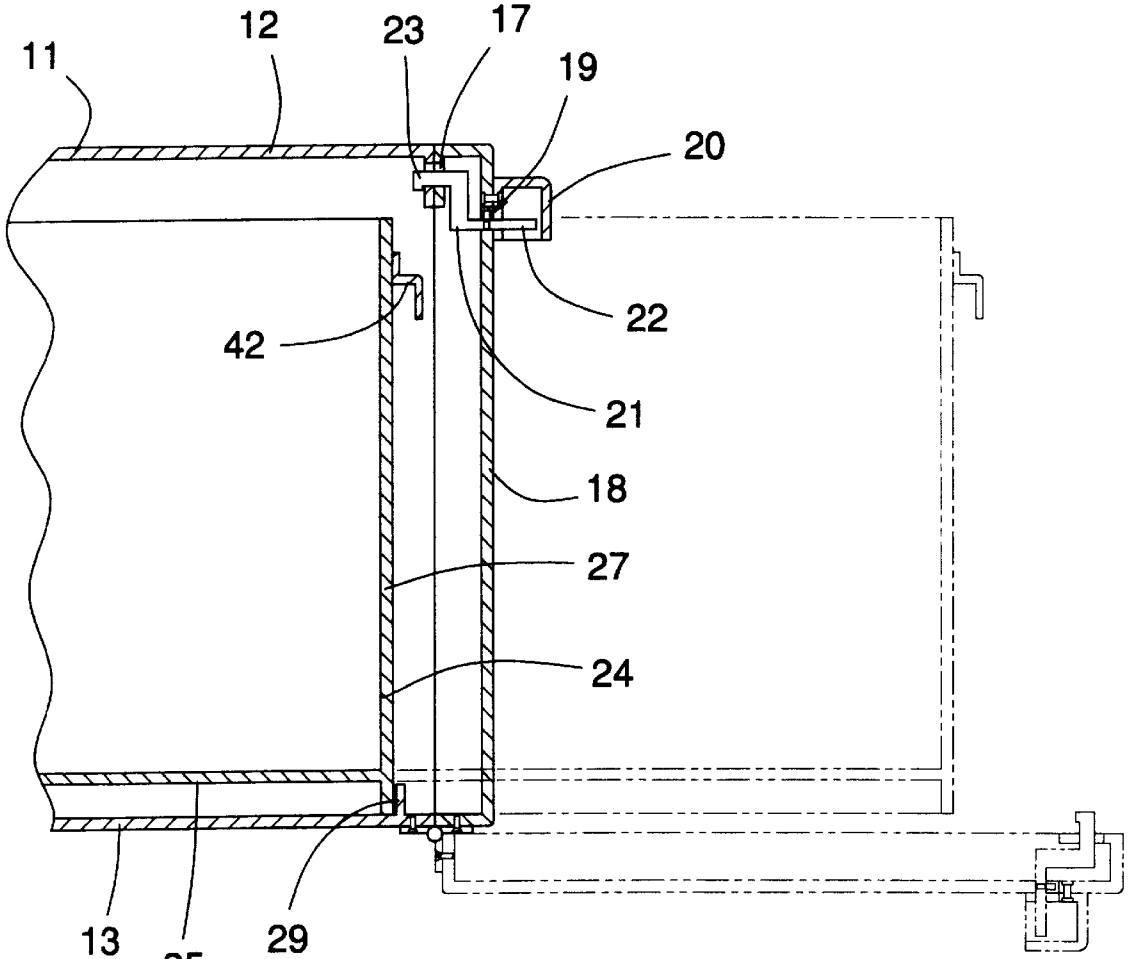
FIG. 4 is a partial cross-sectional view of the present invention.
Figure 5:
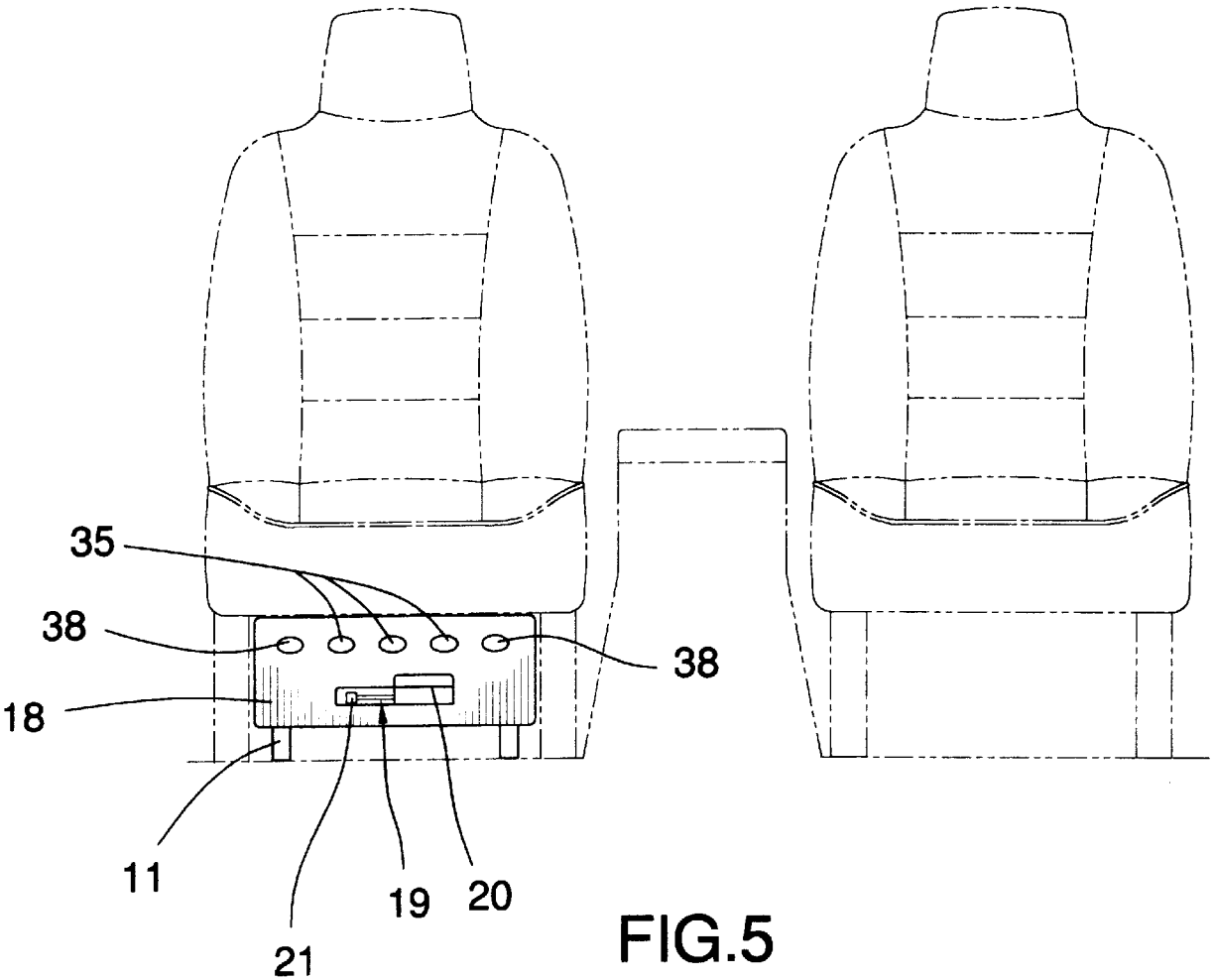
FIG. 5 is another perspective view of the present invention shown in use.
Figure 6:
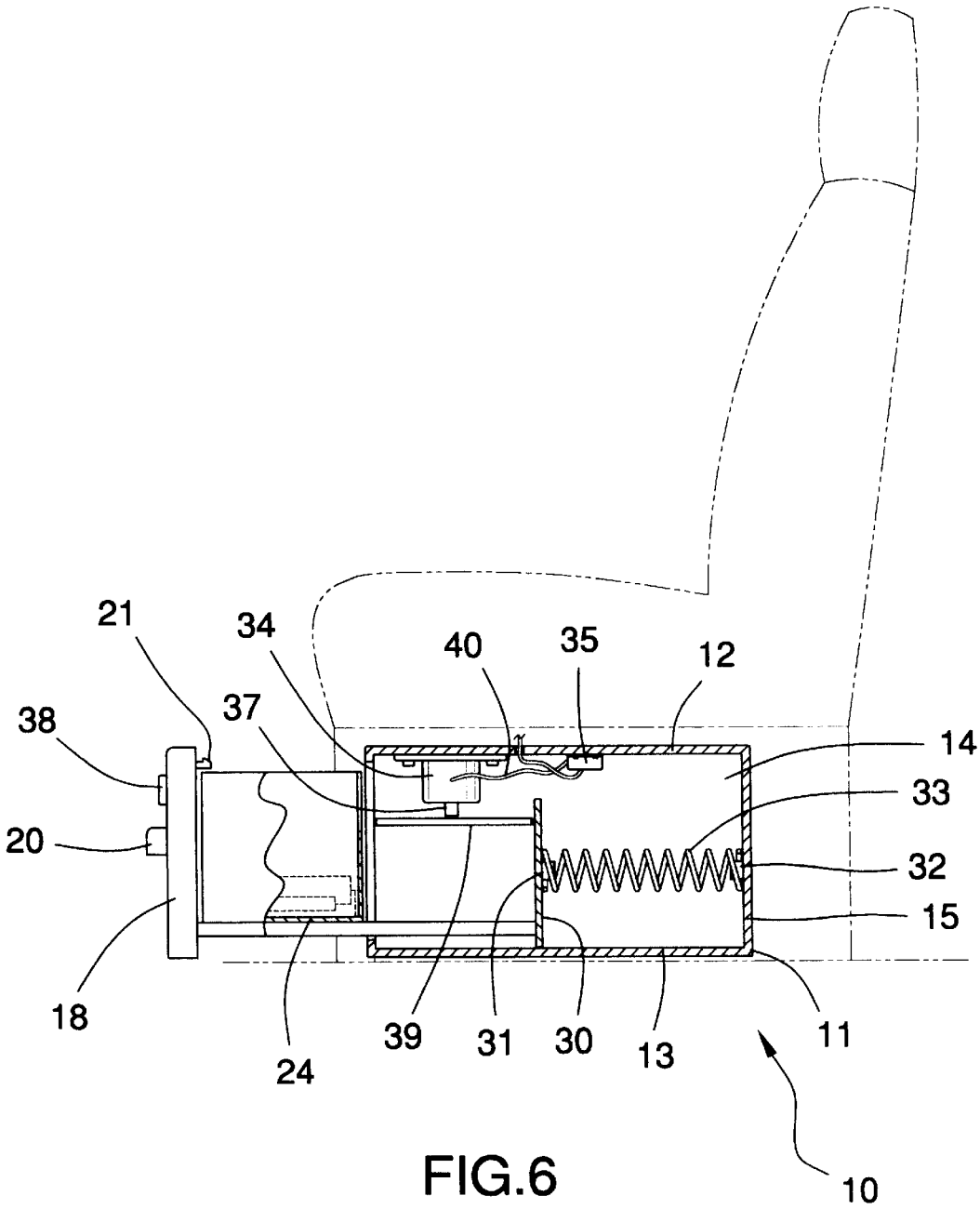
FIG. 6 is another cross-sectional view of the present invention.

With reference now to the drawings, and in particular to FIGS. 1 through 6 thereof, a new vehicle trash compactor embodying the principles and concepts of the present invention and generally designated by the reference numeral 10 will be described.

As best illustrated in FIGS. 1 through 6, the vehicle trash compactor 10 generally comprises a container assembly including a container 11 having top, bottom, back, and side walls 12–15, and also an open front 16. The container assembly also includes a catch member 17 being conventionally attached to one of the walls 12 of the container 11.

The container assembly further includes a door 18 being removably closed over the open front 16 of the container 11 and having a slot 19 therethrough, and also includes a latch 21 being slidably and conventionally disposed in the slot 19 of the door 18 and being engagable to the catch member 17 to securely latch the door 18 to the container 11, and further includes a handle 20 being conventionally attached to an outer side of the door 18 for opening and closing the door 18 with the latch 21 having a handle portion 22 extending through the slot 19 in the door 18 and also having a hook portion 23 which is engagable to the catch member 17.

A drawer assembly includes a drawer 24 being removably disposed in e container 11 through the open front 16 thereof, and having bottom, side, and front walls 25–27, and also having an angled rim 28 for holding a trash bag. The container assembly also includes a drawer stopper member 29 being securely and conventionally attached to the inner side and near a bottom of the door 18 for preventing movement of the drawer 24 when the vehicle trash compactor is in operation. The drawer 24 also includes an open back. The drawer assembly further includes a handle member 42 being conventionally attached to an outer side of the front wall 27 of the drawer 24. As a second embodiment, the drawer 24 also includes a back wall 30, and an open top, and is conventionally attached to the door 18. The drawer assembly further includes bracket members 31,32 being conventionally attached to an outer side of the back wall 30 of the drawer 24 and to an inner side of the back wall 15 of the container 11, and also includes a spring 33 being conventionally attached to the bracket members 31,32 to prevent the drawer 24 from unintentionally being removed from the container 11.

A means of compacting trash in the drawer 24 includes a motor 34 being conventionally attached in the container 11, and also includes a compacting member 39 being movable in and out of the drawer 24 through either the open top or the open bottom for compacting trash in is the drawer 24. The means of compacting trash in the drawer 24 further includes a telescoping drive member 36,37 being conventionally attached to the motor 34 and being also conventionally attached to the compacting member 39 for moving the compacting member 39, and also includes switch members 35 being conventionally attached to the container 11 and being conventionally connected to the motor 34 with wires 40 and also being adapted to be connected with wires 40 to a power supply 41 of a vehicle for energizing the motor 34, and further includes light-emitting indicators 38 being conventionally connected to the switch members 35 for indicating the energizing of the motor 34. The telescoping drive member 36,37 includes a base tubular member 36 being conventionally attached to the motor 34, and also includes tubular rams 37 being telescopingly and conventionally disposed in and from the base tubular member 36 and being engageable to the compacting member 39 with the compacting member 39 being a panel for compacting the trash in the drawer 24.

In use, the container assembly is located either under the passenger seat or in the console between the passenger seats, and the user opens the door 18 and slides the drawer 24 out of the container 11, and places the trash bag about the angled rim 28 of the drawer 24 and puts trash in the trash bag and slides the drawer 24 back into the container 11, and closes the door 18 using the latch 21, and then depresses the switch members 35 to energize the motor 34 which moves the tubular rams 37 and the compacting member 39 into the drawer 24 thus squashing the trash into a compact form which can be removed from the drawer 24 and disposed of.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the vehicle trash compactor. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vehicle trash compactor comprising:

a container assembly including a container having top, bottom, back, and side walls, and also an open front, said container assembly also including a catch member being attached to one of said walls of said container, said container assembly further including a door being removably closed over said open front of said container and having a slot therethrough, and also including a latch being slidably disposed in said slot of said door and being engageable to said catch member to securely latch said door to said container, and further including a handle being attached to an outer side of said door for opening and closing said door, said latch having a handle portion extending through said slot in said door and also having a hook portion which is engageable to said catch member;

a drawer assembly including a drawer being removably disposed in said container through said open front thereof, and having bottom, side, and front walls, and also having an angled rim for holding a trash bag, said container assembly also including a drawer stopper member being securely attached to said inner side and near a bottom of said door for preventing movement of said drawer when said compactor is in operation; and a means of compacting trash in said drawer including a motor being attached in said container, and also including a compacting member being movable in and out of said drawer for compacting trash in said drawer.

2. A vehicle trash compactor comprising:

a container assembly including a container having top, bottom, back, and side walls, and also an open front, said container assembly also including a catch member being attached to one of said walls of said container, said container assembly further including a door being removably closed over said open front of said container and having a slot therethrough, and also including a latch being slidably disposed in said slot of said door and being engageable to said catch member to securely latch said door to said container, and further including a handle being attached to an outer side of said door for opening and closing said door, said latch having a handle portion extending through said slot in said door and also having a hook portion which is engageable to said catch member;

a drawer assembly including a drawer being removably disposed in said container through said open front thereof, and having bottom, side, and front walls, and also having an angled rim for holding a trash bag, said drawer also including a back wall, and an open top through which said compacting member is movable, and being attached to said door, said drawer assembly further including bracket members being attached to an outer side of said back wall of said drawer and to an inner side of said back wall of said container, and also including a spring being attached to said bracket members to prevent said drawer from unintentionally being removed from said container; and a means of compacting trash in said drawer including a motor attached in said container, and also including a compacting member being movable in and out of said drawer for compacting trash in said drawer, said means of compacting trash in said drawer further including a telescoping drive member being attached to said motor and being also attached to said compacting member for moving of said compacting member, and also including switch members being attached to said container and being connected to said motor with wires and also being adapted to be connected with wires to a power supply of a vehicle for energizing said motor, and further including light-emitting indicators being connected to said switch members for indicating the energizing of said motor, said telescoping drive member including a base tubular member being attached to said motor, and also including tubular rams being telescopingly disposed in and from said base tubular member and being engageable to said compacting member, said compacting member being a panel for compacting the trash in said drawer.

* * * * *